US008062050B2

(12) United States Patent
Wu

(10) Patent No.: US 8,062,050 B2
(45) Date of Patent: Nov. 22, 2011

(54) CABLE ASSEMBLY WITH IMPROVED GROUNDING MEMBER

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/851,159

(22) Filed: Aug. 5, 2010

(65) Prior Publication Data

US 2011/0034062 A1 Feb. 10, 2011

(30) Foreign Application Priority Data

Aug. 5, 2009 (CN) ..... 2009 2 0307389

(51) Int. Cl.
*H01R 13/627* (2006.01)

(52) U.S. Cl. ..... 439/350; 439/98; 439/497; 439/607.44

(58) Field of Classification Search ..... 439/350, 439/607.44–607.5, 497, 494, 98
See application file for complete search history.

(56) References Cited

U.S. PATENT DOCUMENTS 4,681,382 A * 7/1987 Lockard ..... 439/92
7,618,293 B2 * 11/2009 Wu ..... 439/660
7,632,155 B1 * 12/2009 Wu ..... 439/660
7,909,632 B2 * 3/2011 Wu ..... 439/353
2010/0233907 A1 * 9/2010 Wu ..... 439/607.58
2011/0008990 A1 * 1/2011 Wu et al. ..... 439/357
2011/0034061 A1 * 2/2011 Wu ..... 439/345

FOREIGN PATENT DOCUMENTS

CN 200420022197 9/2005

* cited by examiner

*Primary Examiner* — Hae Moon Hyeon
(74) *Attorney, Agent, or Firm* — Wei Te Chung; Andrew C. Cheng; Ming Chieh Chang

(57) ABSTRACT

An cable assembly includes an insulative housing; a plurality of signal terminals and grounding terminals received in the insulative housing; a plurality of signals wires and grounding wires; a grounding member having a main portion located in a vertical plane and a plurality of fingers projecting forwardly therefrom, the main portion defining positioning cavities separated from each other; the signal wires held in the positioning cavities, with conductors of the signal wires electrically connected to the signal terminals, the grounding wires electrically connected to the grounding member and the fingers of the grounding member electrically connected to the grounding terminals.

20 Claims, 6 Drawing Sheets

CABLE ASSEMBLY WITH IMPROVED GROUNDING MEMBER

FIELD OF THE INVENTION

The present invention generally relates to a cable assembly, and more particularly to a cable assembly with an improved grounding member.

DESCRIPTION OF PRIOR ART

Nowadays, an electrical device has become lower profile and multi-functional, and a cable assembly for the electrical device is also capable of high-speed transmitting, and reliably connection and easily detachable with its counterpart.

CN patent No. 200420022197 issued to Peng on Sep. 7, 2005 discloses a cable assembly. The cable assembly includes an insulative housing, a plurality of terminals accommodated in the insulative housing, a metallic shell enclosing the insulative housing, two locking members mounted to two sides of the insulative housing and two clamping members adapted for securing the two locking members, an external cover and a cable. The aforementioned cable assembly further comprises a spacer mounted to back side of the insulative housing. The spacer has a plurality of grooves thereon to align wires of the spacer. However, the spacer has a certain length along a mating direction which may increase dimension of the cable assembly. In addition, it is inconvenient to solder the wires to the terminals.

Hence, an improved cable assembly is highly desired to overcome the aforementioned problems.

SUMMARY OF THE INVENTION

Accordingly, an object of the present invention is to provide a lower profile and easily manufactured cable assembly.

In order to achieve the object set forth, a cable assembly in accordance with the present invention comprises an insulative housing; a plurality of signal terminals and grounding terminals received in the insulative housing; a cable having a plurality of signals wires and grounding wires; and a grounding member having a main portion located in a vertical plane and a plurality of fingers projecting forwardly from the main portion, the main portion defining a plurality of positioning cavities separated from each other; the signal wires held in the positioning cavities, with conductors of the signal wires electrically connected to the signal terminals, the grounding wires electrically connected to the grounding member and the fingers of the grounding member electrically connected to the grounding terminals.

Other objects, advantages and novel features of the invention will become more apparent from the following detailed description when taken in conjunction with the accompanying drawings.

DETAILED DESCRIPTION OF PREFERRED EMBODIMENTS

Figure 1:
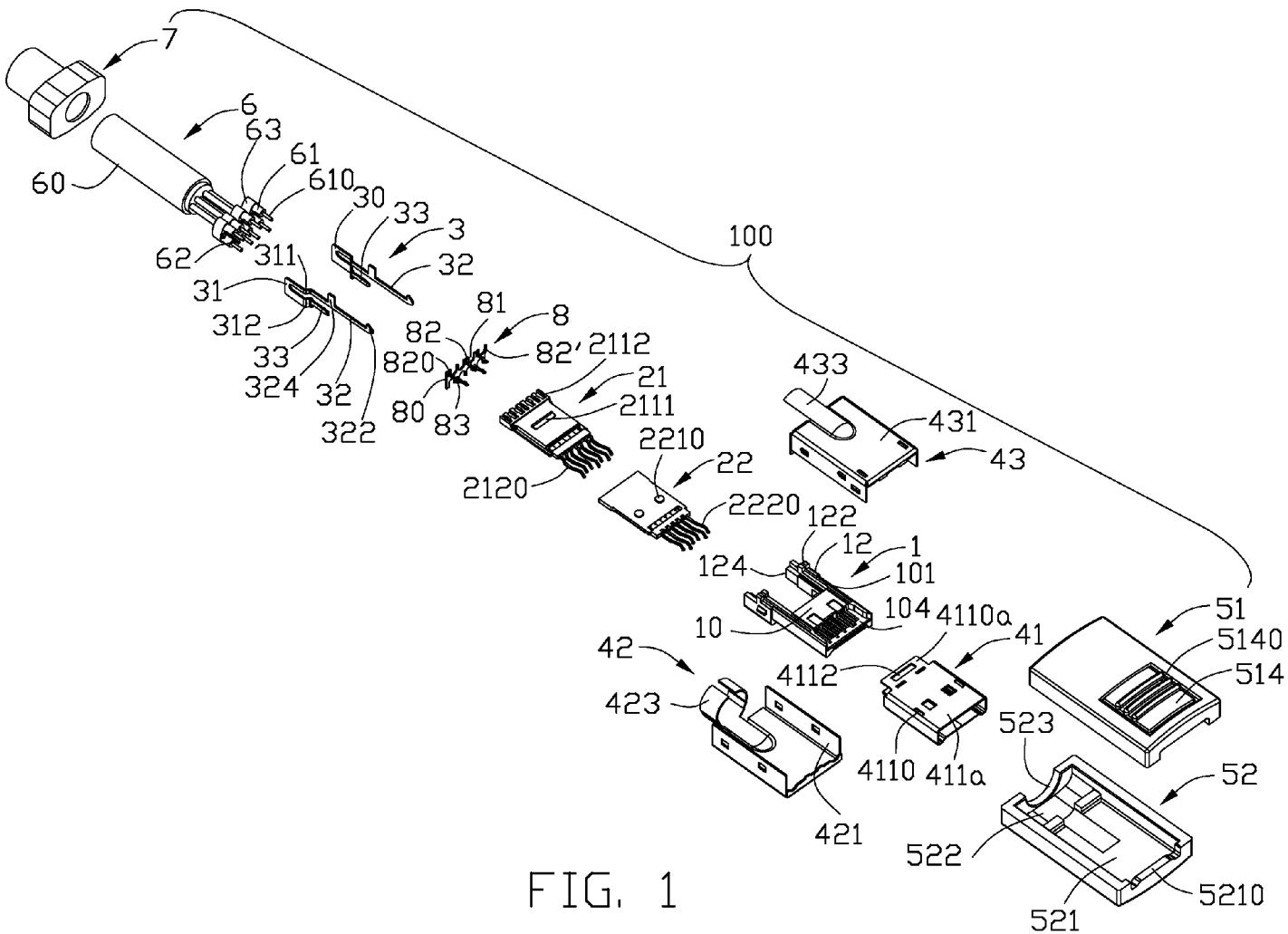
FIG. 1 is an exploded, perspective view of a cable assembly in accordance with the present invention.

Reference will now be made in detail to the preferred embodiment of the present invention.

Referring to FIGS. 1-6, a cable assembly 100 in accordance with the present invention comprises an insulative housing 1, a terminal module 2, two latching members 3, a metallic shell 4, an external cover 5, a cable 6, a strain relief 7 and a grounding member 8.

The insulative housing 1 includes a main portion 10 and two mounting arms 12 extending rearwardly from lateral sides of the main portion 10. A receiving space 102 is recessed forwardly from a middle segment of a rear edge of the main portion 10. A cavity 104 is recessed downwardly from a front segment of a top side of the main portion 10 to form a mating port thereof and further communicates with the receiving space 102. A depression 104' is defined in a lower side of the main portion 10, and the depression 104' is of isosceles trapezoid shape, which has a horizontal side 1041' and two oblique sides 1042'. A slot 101 is defined in the mounting arm 12 and partial of main portion 10 in front of the mounting arm 12. A positioning hole 126 is defined in a rear portion 124 of the mounting arm 12, and a standoff 122 is formed on middle portion of the mounting arm 12 and projected upwardly.

The terminal module 2 includes a first terminal module 21 and a second terminal module 22. The first terminal module 21 has an insulator 211 and a number of terminals 212 combined together by insert-molding process. The terminals 212 are divided into signal terminals and grounding terminals configured to be longer than the signal terminals. The terminals 212 have contacting portions 2120 disposed in front of an edge of the insulator 211 and tail portions 2122 which are accommodated in terminal slots 2112 defined in a back segment of the insulator 211. The terminals 212 further have middle retention sections inside the insulator 211 and between the contacting portions 2120 and tail portions 2122. Two mounting holes 2110 are defined in a bottom side of the insulator 211 and a protruding portion 2111 are formed on a top side of the insulator 211.

The second terminal module 22 has an insulator 221 and a number of terminals 222 combined together by insert-molding process. The terminals 222 are divided into signal terminals and grounding terminals configured to be longer than the signal terminals. The terminals 222 have contacting portions 2220 disposed in front of an edge of the insulator 221 and tail portions 2222 which are accommodated in terminal slots 2212 defined in a back segment of the insulator 221. The terminals 222 further have middle retention sections inside the insulator 221 and between the contacting portions 2220 and tail portions 2222. Two mounting posts 2210 are formed on a top side of the insulator 221. There are two protruding portions 2214 formed on a bottom side of the insulator 221. The insulative housing 1 and the insulators 211, 222 together define an insulative housing unit for positioning the terminals 212, 222.

The first terminal module 21 and the second terminal module 22 are assembled together, with the contacting portions 2120, 2220 merged into one row, while the tail portions 2122, 2222 separated into two distinct rows along an up-to-down direction. The mounting posts 2210 are inserted into the mounting holes 2110 so as to keep the first terminal module 21 and the second terminal module 22 together. The first terminal module 21 and the second terminal module 22 are assembled to the insulative housing 1, with front segments of the insulators 211, 221 inserted into the receiving space 102.

Each latching member 3 includes a connecting arm 30, a latching arm 32 and a retention arm 33. The latching arm 32 and the retention arm 33 are spaced apart from each other and extend forwardly from the connecting arm 30. The latching arm 32 and the retention arm 33 are located in a vertical plane. The connecting arm 30 has a U-shaped body portion 31 and a first bridge portion 311 and a second bridge portion 312 formed with front ends of the body portion 31. The first bridge portion 311 and the second bridge portion 312 are inwardly deflected and extend forwardly to engage with the latching arm 32 and the retention arm 33, respectively. Therefore the U-shaped body portion 31 is disposed in other vertical plane and parallel to the latching arm 32 and the retention arm 33. A tab 324 is formed on a top side of the latching arm 32 and proximate the first bridge portion 311. The retention arm 33 is inserted into the positioning hole 126 of the mounting arm 12, and the latching arm 32 is received in the slot 101 of the insulative housing 1. The connecting arm 30 is located behind the mounting arm 12 and adjacent to an outer surface of the mounting arm 12, therefore, more space is left inside the connecting arm 30.

The metallic shell 4 has a first shell 41, a second shell 42 and a third shell 43. The first shell 41 includes a frame 411 to accommodate the main portion 10 therein. Two through holes 4110 are defined in a front segment of a top side 411*a* of the frame 411 to allow hooks 322 of the latching arm 32 passing through. A first engaging portion 4110*a* projects backward from the top side 411*a*. There is a positioning hole 4112 defined in the first engaging portion 4110*a* to latch with the protruding portion 2111 of the first terminal module 21. The frame 411 has a bottom side 411*b* suitably matching with the depression 104' of the insulative housing 1. A second engaging portion 4110*b* projects backward from the bottom side 411*b*. There are two positioning holes 4114 defined in the second engaging portion 4110*b* to latch with the protruding portions 2214 of the second terminal module 22.

The second shell 42 includes a U-shaped main body 421 and a cable holder 423 integrated with the main body 421 and projecting backwardly. The third shell 43 includes an inverted U-shaped main portion 431 and a tail 433 extending rearward. The second shell 42 and the third shell 43 can be combined together along a vertical direction.

The external cover 5 includes an upper cover 51 and a bottom cover 52. The upper cover 51 has a first hollow 511 and a second hollow 512 disposed behind the first hollow 511. A rectangular shaped opening 5110 is located in the front portion of the upper cover 51, and the opening 5110 further communicates with the first hollow 511. A semicircular shaped outlet 513 is defined in the rear portion of the upper cover 51 and communicated with the second hollow 512. A deformable button 514 is integrally formed with the upper cover 51 and floatable along up-to-down direction to enter the first hollow 511 so as to actuate the tab 324 of the latching arm 32. In addition, a number of ribs 5140 are formed on a top side of the deformable button 514 to increase friction between user's thumb and the deformable button 514.

The bottom cover 52 is similar to the upper cover 51, and also has a first hollow 521 and a second hollow 522 disposed behind the first hollow 521. An opening 5210 is located in the front portion of the bottom cover 52, and the opening 5210 further communicates with the first hollow 521. A semicircular shaped outlet 523 is defined in the rear portion of the bottom cover 52 and communicated with the second hollow 522.

The cable 6 includes a number of wire groups enclosed in a jacket 60. Each wire group includes a pair of signal wires 61 and a grounding wire 62 disposed aside the pair of wires 61, and a shielding member 63 shrouding the pair of wires 61. The shielding member 63 is aluminum foil or other similar structure. The strain relief member 7 is molded over a front segment of the cable 6 and accommodated in the second hollows 512, 522.

The grounding member 8 is made of metallic material or other conductive materials. The grounding member 8 includes a panel-shaped main portion 80 located in a vertical plane, a number of positioning cavities 81 respectively defined in a top and a bottom portions of the main portion 80. The positioning cavities 81 are arranged between first protrusions 82 and second protrusions 82'. The first protrusions 82 and the second protrusions 82' are disposed in alternated manner along a transversal direction. In addition, the first protrusions 82 are broader than the second protrusions 82'. Each of the first protrusions 82 defines a groove 820 therein. The groove 820 is narrower than the positioning cavities 81. A finger 83 projects outwardly and forwardly from the groove 820.

The grounding member 8 is mounted to a back side of the first terminal module 21 and the second terminal module 22. The fingers 83 are inserted into the terminal slots 2112, 2222 and placed on the tail portions 2122, 2212 of the terminals 212, 222 so as to achieve electrical interconnection therebetween. The pair of signal wires 61 of the each wire group are held in the two positioning cavities 81 at the top and the bottom sides of the main portion 80, and conductors 610 inside the signal wires 61 extend into the terminal slots 2112, 2222 and are placed on the tail portions 2122, 2222 so as to achieve electrical connection therebetween. The grounding wire 62 is put into a corresponding groove 820 to form electrical interconnection therebetween. The conductors 610 are soldered to tail portions of the signal terminals, and the fingers 83 are soldered to tail portions of the grounding terminals.

The grounding members 8 are used for organizing the wires of the cable 6 so as to facilitate soldering process and providing a grounding means for the cable 6 and the grounding terminals. Furthermore, the grounding member 8 is made of metallic sheet and has a lower profile.

Figure 2:
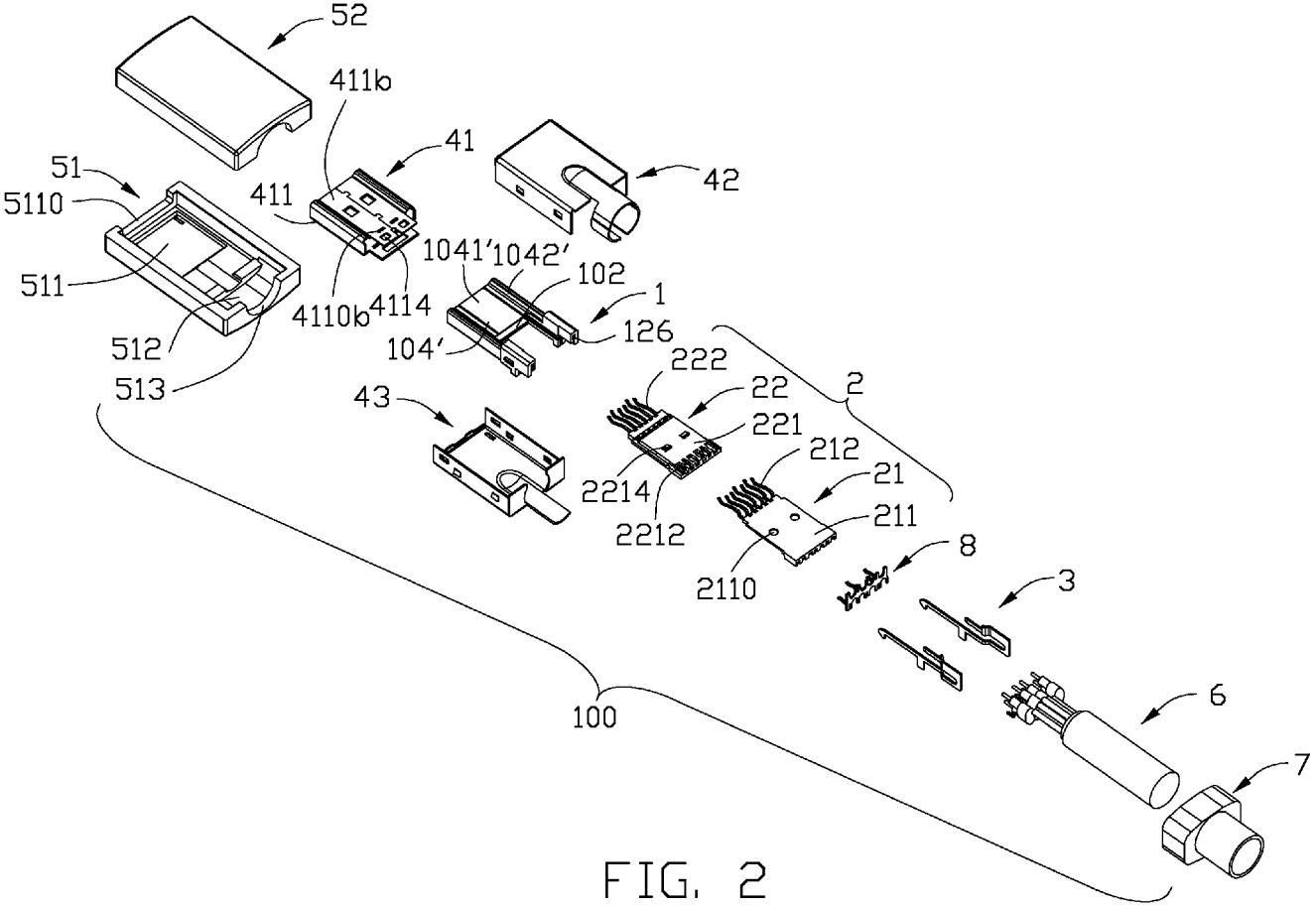
FIG. 2 is similar to FIG. 1, but viewed from another aspect.
Figure 3:
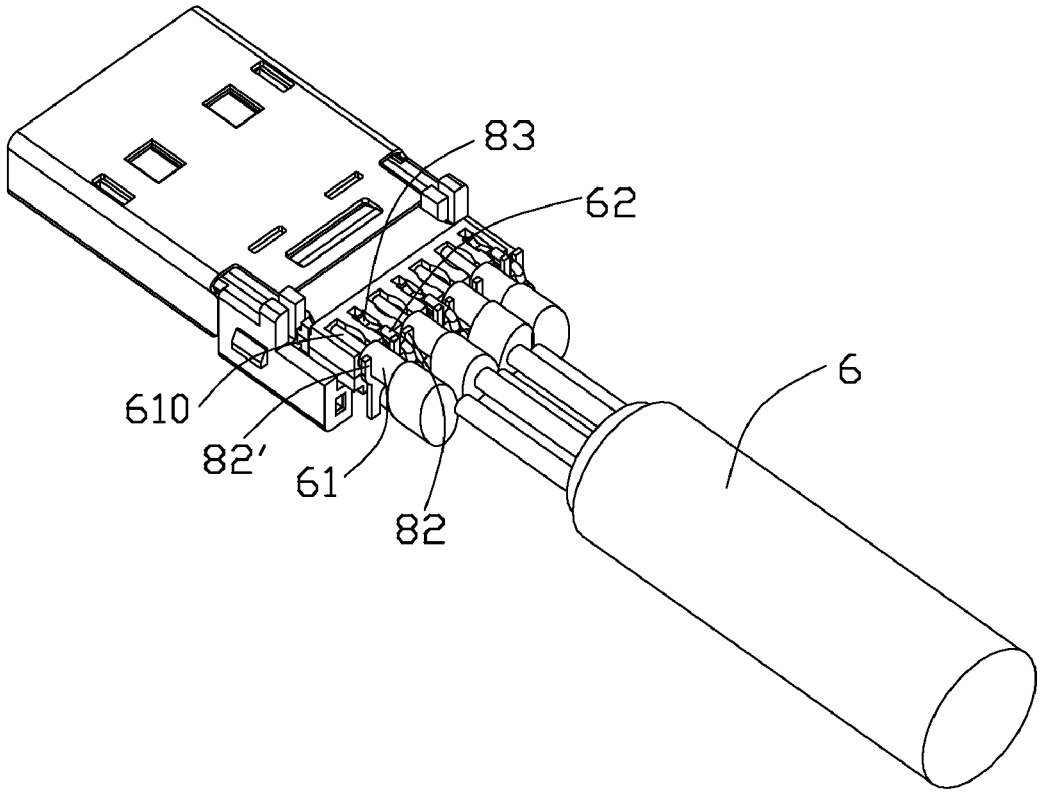
FIG. 3 is a partially assembled view of the cable assembly.
Figure 4:
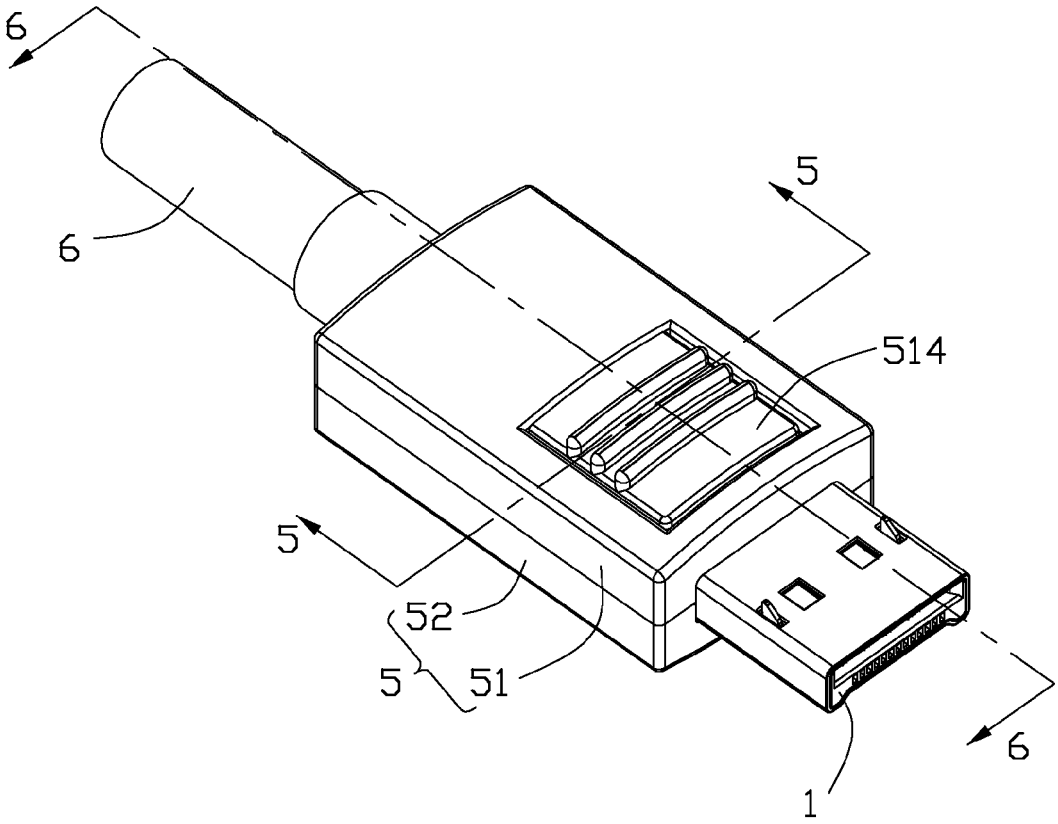
FIG. 4 is an assembled, perspective view of the cable assembly.
Figure 5:
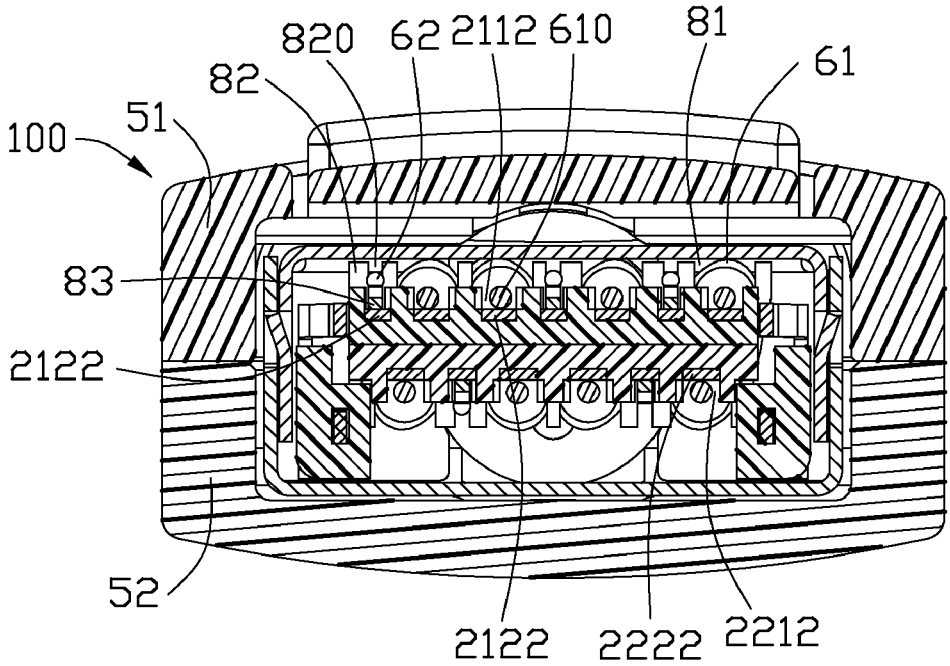
FIG. 5 is a cross-section view taken along line 5-5 of FIG. 4.
Figure 6:
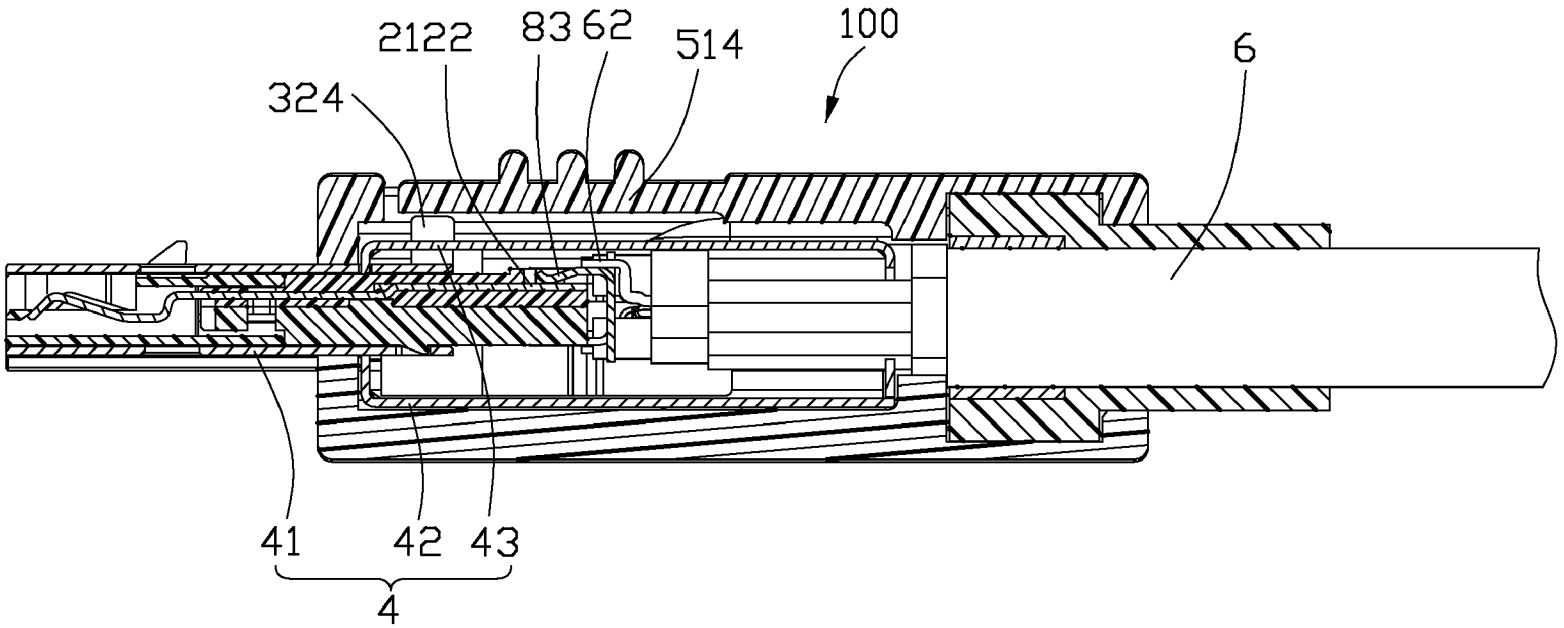
FIG. 6 is a cross-section view taken along line 6-6 of FIG. 4.

The cable assembly 100 is in accordance with DiiVA (Digital Interactive Interface for Video & Audio) standard. Referring to FIG. 1-2, within the cavity 104, along a left-to-right direction, there are thirteen terminals 212, 222 which are arranged in such manner: G-S-S-G-S-S-G-S-S-G-G-S-S. G represents grounding terminal, and S represent signal terminal. There are three differential pairs consisted of six signal terminals located between grounding terminals. The differential pairs for high-speed transmitting used for conveying video signals. And a pair of signal terminals disposed in the right side cavity 104 used for audio signals.

When detach the cable assembly 100 from a complementary connector, just press the deformable button 514 to actuate the tab 324 of the latching arm 32, and the latching arm 32 retreat into the slots 101. When the pressing force is withdrawn, the deformable button 514 restored to their original positions, and the latching arms 32 also upwardly movement by rebounded force of the resilient tabs 304.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing;

a plurality of signal terminals and grounding terminals received in the insulative housing;

a cable having a plurality of signal wires and grounding wires; and a grounding member having a main portion located in a vertical plane and a plurality of fingers projecting forwardly from the main portion, the main portion defining a plurality of positioning cavities separated from each other; the signal wires held in the positioning cavities, with conductors of the signal wires electrically connected to the signal terminals, the grounding wires electrically connected to the grounding member and the fingers of the grounding member electrically connected to the grounding terminals.

2. The cable assembly as recited in claim 1, wherein the main portion of the grounding member has a number of protrusions to separate the positioning cavities, and the grounding wires are electrically connected to the protrusions.

3. The cable assembly as recited in claim 2, wherein each of the protrusions defines a groove to receive one of the grounding wires.

4. The cable assembly as recited in claim 1, wherein there is an insulator combined with the signal terminals and the grounding terminals to form a terminal module.

5. The cable assembly as recited in claim 4, wherein the terminals have contacting portions disposed in front of the insulator and tail portions accommodated in terminal slots which are defined in a back segment of the insulator.

6. The cable assembly as recited in claim 5, wherein the fingers of the grounding member are received in the corresponding terminal slots and placed on the tail portions of the grounding terminals.

7. The cable assembly as recited in claim 5, wherein the conductors of the signal wires are received in the corresponding terminal slots and placed on the tail portions of the grounding terminals.

8. A cable assembly, comprising:

an insulative housing;

a plurality of terminals including signal terminals and grounding terminals received in the insulative housing;

a cable having a number of wire groups, each of the wire groups including a pair of signal wires and a grounding wire disposed aside the pair of signal wires; and a grounding member having a main portion and a plurality of fingers projecting forwardly from the main portion, the main portion defining a plurality of positioning cavities defined in a top and a bottom portions of the main portion; the signal wires of the each of the wire groups located in two of the positioning cavities respectively arranged in the top and the bottom portions of the main portion, with conductors of the signal wires electrically connected to the signal terminals, the grounding wire of the each of the wire groups electrically connected to the grounding member and the fingers of the grounding member electrically connected to the corresponding grounding terminals.

9. The cable assembly as recited in claim 8, wherein the main portion of the grounding member has a number of protrusions to separate the positioning cavities, and the grounding wires are electrically connected to the protrusions.

10. The cable assembly as recited in claim 9, wherein there are grooves defined in corresponding protrusions to receive the grounding wires.

11. The cable assembly as recited in claim 10, wherein the fingers extend forwardly from the grooves.

12. The cable assembly as recited in claim 10, wherein the protrusions includes first protrusions and second protrusions disposed in alternated manner along a transversal direction.

13. The cable assembly as recited in claim 12, wherein the first protrusions are broader than the second protrusions.

14. The cable assembly as recited in claim 13, wherein the grooves are defined in the first protrusions.

15. The cable assembly as recited in claim 8, wherein the terminals are divided into two rows and respectively combined with an insulator to form a first terminal module and a second terminal module.

16. The cable assembly as recited in claim 15, wherein the terminals have contacting portions arranged in a row along a transversal direction and tail portions divided into two rows along a vertical direction.

17. A cable connector assembly comprising:

an insulative housing unit defining a mating port in a front portion;

a plurality of contacts disposed in the housing unit, each of said contacts defining a front a mating section, a rear tail section and a middle retention section therebetween, said contacts being categorized with signal contacts and grounding contacts, the rear tail sections being transversely confined in corresponding terminal slots defined in a rear portion of the housing unit;

a grounding member located behind the rear tail sections of the contacts and including a plurality of fingers mechanically and electrically abutting against the tail sections of the corresponding grounding contacts, said grounding member defining a plurality of grooves; and a plurality of wires including signal wires soldered to the rear tail sections of the corresponding signal contacts, and grounding wires received within the grooves of the grounding member; wherein the signal wires are transversely confined by the corresponding terminal slots while the grounding wires are transversely confined by the corresponding grooves.

18. The cable connector assembly as claimed in claim 17, wherein the grounding wires are soldered upon the corresponding fingers.

19. The cable connector assembly as claimed in claim 17, wherein said grounding member defines a plurality of positioning cavities transversely alternately arranged with the grooves to position the corresponding signal wires, respectively.

20. The cable connector assembly as claimed in claim 17, wherein the housing unit includes an insulator, and the terminal slots are formed by said insulator which integrates the contacts together.

* * * * *